United States Patent [19]

Dwight

[11] Patent Number: 4,673,178

[45] Date of Patent: Jun. 16, 1987

[54] EXERCISE MACHINE HAVING VARIABLE RADIUS CRANK ARM

[76] Inventor: William H. Dwight, 430 Park St., Birmingham, Mich. 48009

[21] Appl. No.: 822,203

[22] Filed: Jan. 24, 1986

[51] Int. Cl.[4] ..... A63B 21/00

[52] U.S. Cl. ..... 272/73; 74/600

[58] Field of Search ..... 272/73, DIG. 4; 74/594.1, 546, 586, 600

[56] References Cited

U.S. PATENT DOCUMENTS

| | | | |
|---|---|---|---|
| 334,635 | 1/1886 | Bowen | 272/73 |
| 363,522 | 5/1887 | Knous | 74/594.1 |
| 421,969 | 2/1890 | Pond | 74/594.1 |
| 2,641,249 | 6/1953 | Brockman | 272/73 |
| 4,606,241 | 8/1986 | Fredriksson | 272/73 |

*Primary Examiner*—Richard J. Apley
*Assistant Examiner*—S. R. Crow
*Attorney, Agent, or Firm*—Reising, Ethington, Barnard, Perry & Milton

[57] ABSTRACT

An exercise machine assembly (10) includes a body portion (12), handlebars (16) mounted on the body portion (12) and a seat (18). A pair of crank arms (26) are supported by the body portion (12) for rotational movement. A foot pedal (28) is mounted on an axle member (30) extending from each of the crank arms (26). The foot pedals (28) are mounted on adjustable supports for adjustably supporting each of the foot pedals (28) at any one of a plurality of positions along the entire length of the crank arm (26).

12 Claims, 9 Drawing Figures

EXERCISE MACHINE HAVING VARIABLE RADIUS CRANK ARM

TECHNICAL FIELD

The subject invention relates to exercise devices. More specifically, the subject invention relates to bicycle type exercising apparatus including a seat, handlebars, and foot pedals which are mechanically connected to a resistance producing mechanism for producing resistance against the cyclic pedaling motion.

BACKGROUND ART

A common problem seen in orthopedics and sports physical therapy practice are problems involving the knee. Among those problems, the most common involve the patello-femoral surface. The patello-femoral surface is the surface between the knee cap and the femur. Commonly, the patello-femoral surface is erupted due to trauma or disease. Such cases cause two problems clinically. One problem is pain and the second is loss of range of motion of the knee. The stationary bicycle is an excellent exercise medium to promote resurfacing of the damaged patello-femoral articulation. Resurfacing is smoothing of the internal surface by mechanical means, such as the rubbing of the femur against the surface. The high speed activities of the exercycling allow for polishing of that surface, with low compression of the patello-femoral joint, thus reducing the discomfort while at the same time allowing for strengthening of the musculature crossing for the knee joint. Predominately, the musculature are the hamstrings and quadriceps muscle groups.

The limiting factor in using the exercise bicycle comes when there is also limitation of range of motion of the joint. This occurs because there is a required range of motion in order to complete a full circle of the foot pedal while keeping the foot on pedal. An individual must have approximately 109° of active knee flexion in order to complete the upper end of the circle where the knee flexion is greater, and there is approximately a 79° change in range of motion as they move into forward extension. By merely changing the level of the seat height, one can often increase flexion, but there is no mechanism presently available to decrease the flexion required to complete a full rotation. For example, the U.S. Pat. No. 4,509,742 to Cones, issued Apr. 9, 1985, discloses an exercise bicycle equipped with an adjustable seat and a pair of flywheels mounted on a drive shaft on opposite sides of a pump housing. Each one of a pair of foot pedals is mounted on a different one of the flywheels. A number of spaced apart mounting locations are provided on each of the flywheels for adjusting the distance between pedals on the flywheels so that the diameter of rotation of the pedals may be adjusted for person of different heights. The U.S. Pat. No. 2,641,249 to Brockman, issued June 9, 1953 discloses an adjustable foot support device for an exercising machine. The length of the crank arm may be adjusted by a sliding connection which may be secured to a wing nut. The U.S. Pat. No. 385,717 to Kibbe, issued July 10, 1888 discloses an extensible crank arm for a bicycle of the like including a crank arm comprising two parts. One end of a first part is connected pivotally to a connecting member or loop which is slideably connected to the first crank arm. A locking mechanism fixes one crank arm relative to the second such that the length of the combined crank arms can be adjusted.

STATEMENT OF THE INVENTION

According to the present invention, there is provided an exercise machine assembly including a body portion, handle means mounted on the body portion for being manually grasped, a seat supported by the body portion and spaced from the handle means, and a pair of crank arms supported by the body portion for rotational movement. A foot pedal is mounted on each of the crank arms. The assembly includes adjustable pedal support means for adjustably fixedly supporting each of the pedals at any one of a plurality of positions along the entire length of the crank arms.

The present invention further provides a method of adjusting an exercise bicycle assembly including the steps of increasing the distance between the seat and the body and decreasing the distance between the pivotal connection of the foot pedal and the pivotal connection of the crank arm.

FIGURES IN THE DRAWINGS

Other advantages of the present invention will be readily appreciated as the same becomes better understood by reference to the following detailed description when considered in connection with accompanying drawings wherein.

DETAILED DESCRIPTION OF THE DRAWINGS

Figure 1:
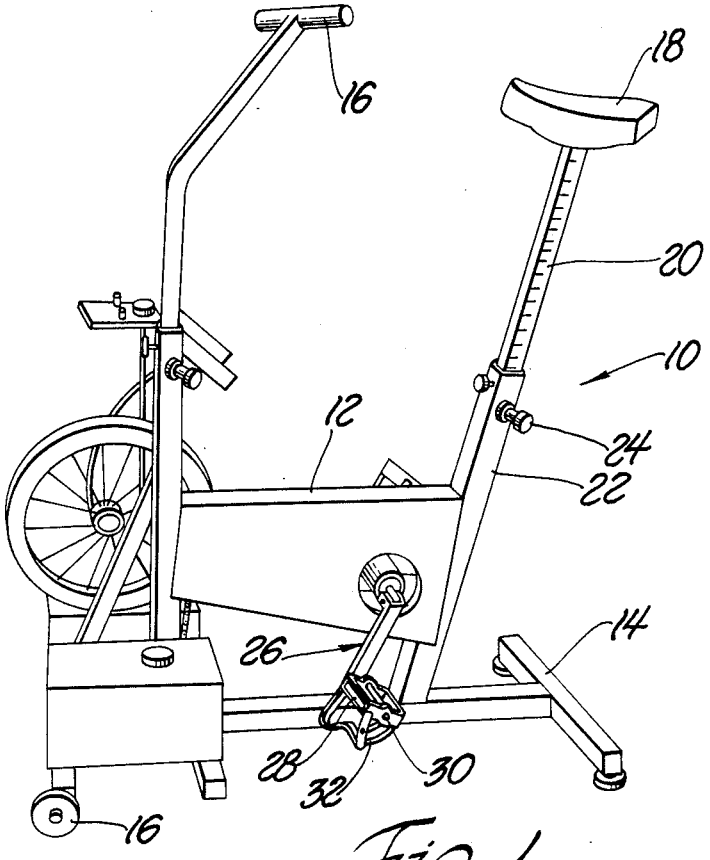
FIG. 1 is an elevational perspective view of an exercise machine constructed in accordance with the instant invention.
Figure 2:
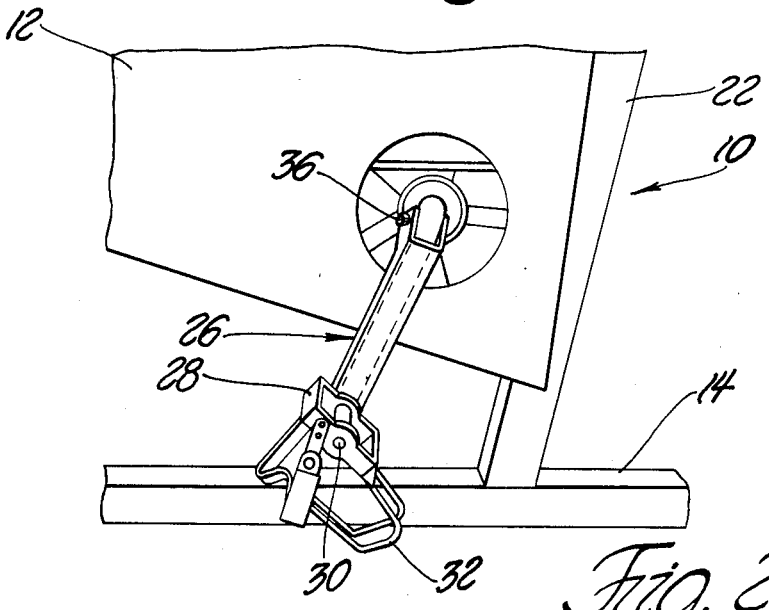
FIG. 2 is an enlarged view of the adjustable crank arm constructed in accordance with the instant invention.

An exercise machine assembly constructed in accordance with the instant invention is generally shown at 10. The exercise machine 10 generally includes a stationary support frame or body portion 12. The body portion 12 may include a frame 14 for maintaining the assembly 10 in the upright position. The body 12 may also include wheels 16 to facilitate moving of the assembly 10.

The assembly 10 includes handlebars 16 mounted on the body portion 12 for being manually grasped. A seat 18 is supported by the body portion 12 and spaced from the handlebars 16. The seat 18 may be a typical bicycle type seat.

The assembly 10 includes variable length seat support means for selectively spacing the seat 18 from the body portion 12 of the assembly 10. The variable length seat support means includes a shaft member 20 having two ends and a predetermined length. The seat 18 is mounted on one end of the shaft member 20. The body portion 12 of the assembly 10 includes a port contained within a neck portion 22 for telescopically receiving the other end of the shaft member 20.

The variable length seat support means further includes locking means for locking selected portions of the shaft member 20 along the length thereof within neck portion 22. The locking means includes a bolt member 24 which can be screwed into the neck portion 22 to engage and fixedly secure the shaft 20 at a predetermined position. The bolt member 24 may be unscrewed to release the shaft 20 and adjust the length thereof outside of the neck portion 22 to adjust the distance between the seat 18 and the body portion 12 of the assembly 10. The shaft 20 includes a plurality of markings which indicate the specific length of the shaft portion 20 exposed from the neck portion 22 thereby indicating the specific distance of the seat member 18 from the body portion 12. By utilizing the numerical indications on the shaft member 20, repeatable spacing of the seat 18 from the body portion 12 can be accomplished.

The assembly 10 includes a pair of crank arms generally indicated at 26 supported by the body portion 12 for rotational movement about a pivotal connection. A foot pedal 28 is mounted on each of the crank arms 26 about an axle member 30 defining pivotal connection 30. A safety strap 32 may be mounted on the pedal to help retain the riders foot thereon.

Figure 7:
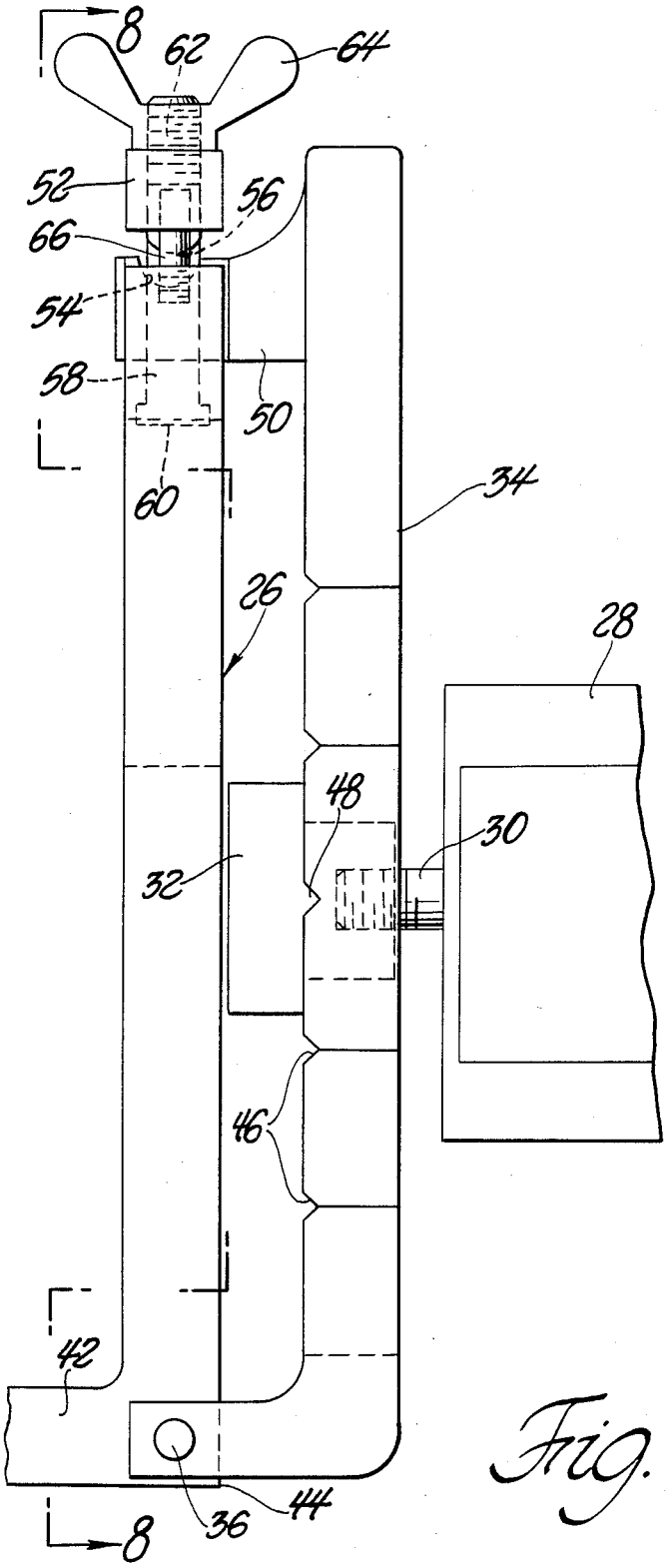
FIG. 7 is side elevational view of the pedal crank arm constructed in accordance with the instant invention.
Figure 8:
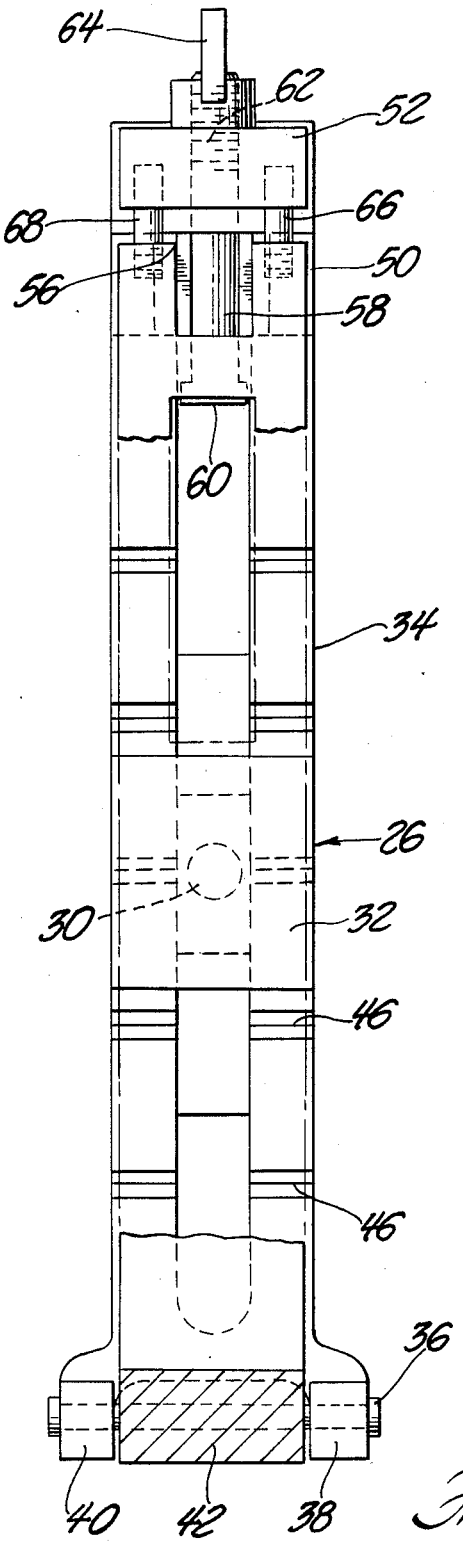
FIG. 8 is view taken substantially along lines 8—8 of FIG. 7.
Figure 9:
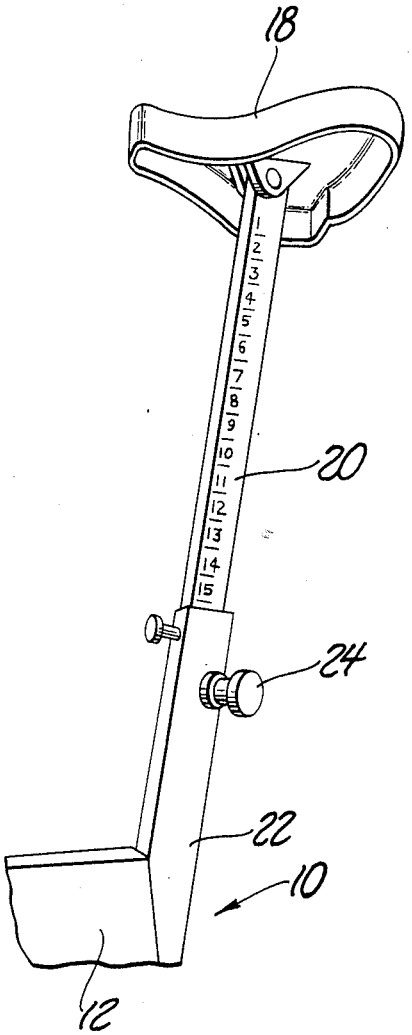
FIG. 9 is an enlarged perspective view of a seat constructed in accordance with the instant invention.

The assembly 10 includes adjustable pedal support means for adjustably fixedly supporting each of the pedals 28 at any one of a plurality of positions along the entire length of the crank arms 26. More specifically, and referring in particular to FIGS. 7 and 8, the assembly 10 includes a pedal block 32. The axle member 30 is pivotally mounted on and extends from the pedal block 32. In other words, the pedal block 32 pivotally supports the foot pedal 28 through the axle member 30 for rotational movement relative thereto. The adjustable pedal support means includes a clamping arm 34 pivotally connected to the crank arm 26 at a pivotal connection 36. The pivotal connection 36 may be a bolt extending through the crank arm 26 and winged spaced flanges 38 and 40 of the clamping arm 34 thereby pivotally connecting the clamping arm 34 to the crank arm 26. The crank arm 26 is connected to the body portion 12 by an arm portion 42 extending from an elbow 44 of the crank arm 26. The extending arm 42 defines the axis of a pivotal connection between the crank arm 26 and the body portion 12.

The assembly 10 includes crank arm locking means for locking the clamping arm 34 to the crank arm 26. The clamping arm 34 has an unclamped position wherein the pedal block 32 is movable along the entire length of the crank arm 26 and a clamped position wherein the pedal block 32 is fixedly clamped between the crank arm 26 and clamping arm 34 at a position along the length of the crank arm 26. Indexing means fixedly secures the pedal block 32 at one of a plurality of predetermined spaced positions along the entire length of the crank arm 34. As shown in the Figures, the indexing means includes a plurality of notches 46 extending along the length of the clamping arm 36 in predetermined spaced positions. The pedal block 32 includes a projection 48 for mating engagement with at least one of the spaced notches 46 for indexing the pedal block 32 along the entire length of the clamping arm 34. Alternatively, the pedal block 32 may include a notch and the clamping arm 34 includes projections. Of course, alternative embodiments can be made where the notches or projections are on the crank arm 26 or on both the crank arm 26 and clamping arm 34.

The crank arm locking means includes a leg 50 extending substantially perpendicularly from the clamping arm 34 towards the crank arm 26 and an adjustable locking member 52 for selectively engaging the leg 50 for retaining the leg 50 adjacent to the crank arm 26. More particularly, the leg 50 includes a notch 54 therein. The notch 54 extends along the top surface of the leg 54. The notch 54 may take the form of a trough or other indentation in the top surface of the leg 50. The locking member 52 includes a projection 56 extending downwardly therefrom. The locking member 52 is adjustably mounted on the crank arm 26 to be movable from a locking position wherein the projection 56 is seated within the notch 54 to an unlocked position wherein the projection 56 is spaced from the notch 54. This is accomplished by the locking member 52 being mounted on an adjustable bolt member 58. The bolt member 58 has a first end 60 connected to the crank arm 26 and a threaded body portion 62 extending through the locking member 52. The locking means further includes a nut member 64 mounted on the threaded body portion 62 of the bolt member 58 for securing the locking member 52 in the locked position and selectively releasing the locking member 52 therefrom.

The crank arm 26 has a first end at the elbow 44 thereof pivotally connected to the clamping arm 34 and a second end having the locking member 52 mounted thereon. The crank arm 26 includes guide means for supporting the locking member between the locked and unlocked positions. The guide means includes a pair of spaced pins 66 and 68 extending from the second end of the crank arm 26, the locking member 52 being slideably supported along the pins 66,68.

The operation of the subject invention is illustrated in FIGS. 3–6 whereby a patient who has knee problems previously described and does not have a full range of movement of the leg may be started on an exercise machine even though there is limited mobility of the leg. This is critical because the sooner the exercise begins, the sooner the patient can derive the benefits of the exercise.

Figure 3:
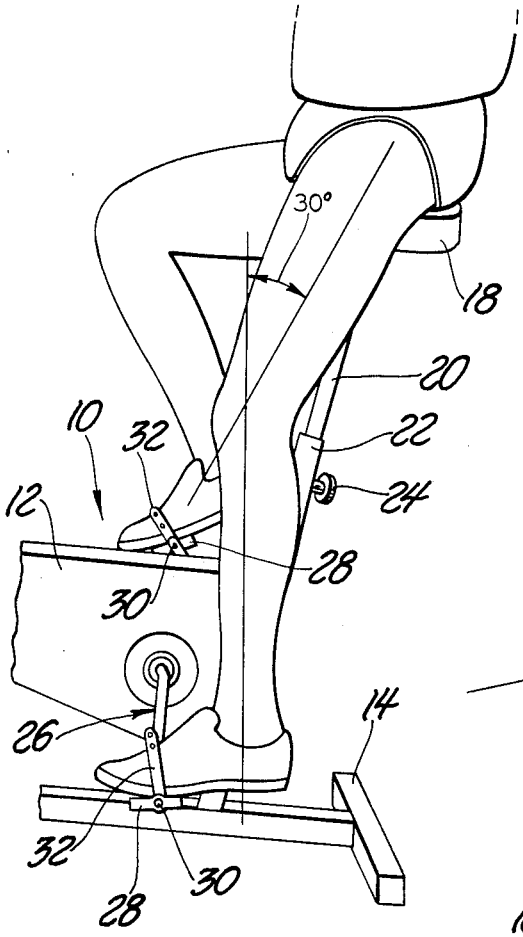
FIG. 3 is a side view of a patient seated on an exercise bicycle prior to adjustment of the variable radius crank arm wherein the patient's foot is at the low point of the pedal circle.
Figure 4:
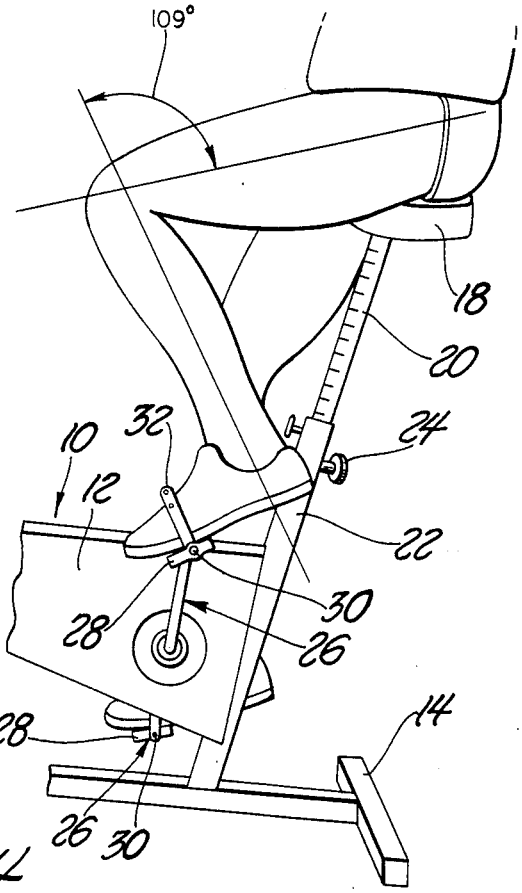
FIG. 4 is a side elevational view of a patient seated on an exercise bicycle wherein his foot is at the high point of the pedal circle.
Figure 5:
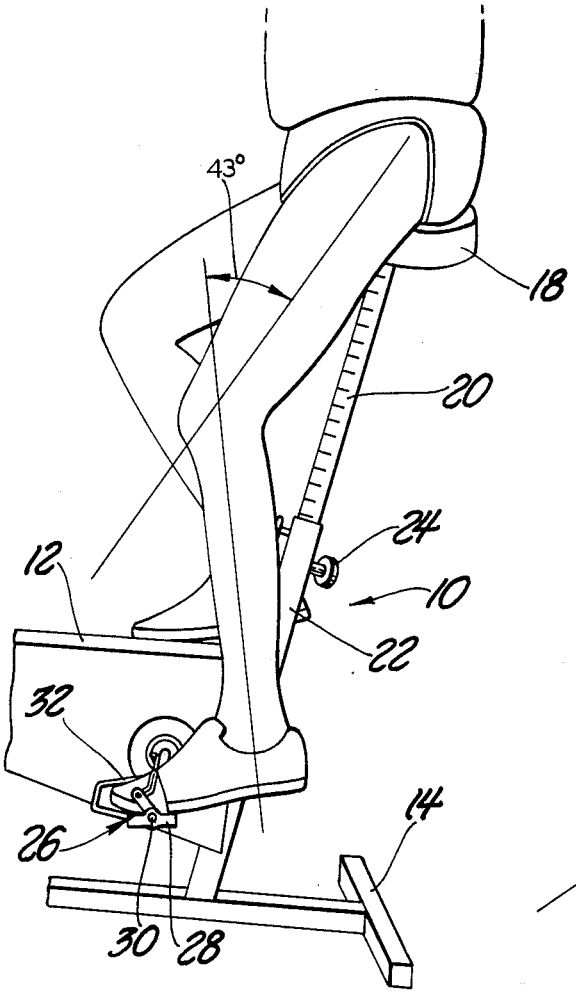
FIG. 5 is an elevational view of a patient seated on an exercise bicycle wherein the radius of the crank arm and the height of the seat have been adjusted in accordance with the instant invention and the patient's foot is at the low point of the pedal circle.
Figure 6:
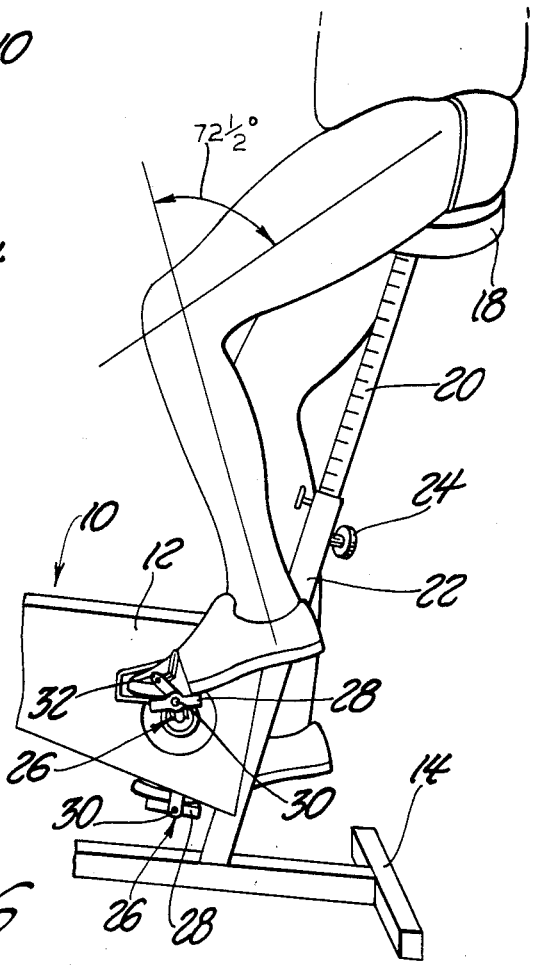
FIG. 6 is a elevational view of a patient seated on an exercise bicycle, the pedal crank arm radius and seat height having been adjusted in accordance with the instant invention and the patient's foot is at the high point of the pedal circle.

Generally, the instant invention provides a bicycle pedal crank arm 26 having a variable radius to alter the crank arm from about $6\frac{1}{2}$ inches to 2 inches. The advantage of such a modification is that it requires less knee flexion to complete a circle of the bicycle pedal 28 when the crank arm radius of the bicycle pedal 28 is reduced. As shown in FIG. 3, when the bicycle crank arm 26 is at its normal length which is approximately $6\frac{1}{2}$ inches, it is at the bottom of its rotation and the patient's leg is flexed at an angle of 30°. As shown in FIG. 4, when the pedal crank arm 26 is at the top of its rotation, the knee is flexed 109°. FIGS. 5 and 6 show the exercise bicycle assembly 10 including the pedal crank arm having the reduced radius in accordance with the instant invention wherein the crank arm radius is effectively reduced in length from 6½ inches to 2 inches. Additionally, the bicycle seat 18 is also raised. At the crank arm's lowest point, as shown in FIG. 5, the knee is flexed 43°. The seat could actually be raised higher to further reduce the flexion. More importantly, when the crank arm is at its highest point, as shown in FIG. 6, the knee is only flexed 72½°. If the seat were adjusted to be higher, such flexion can be reduced to less than 65°. In other words, at the crank arm's highest point, the knee flexion is reduced from 109° to less than 65°. Such a reduction in knee flexure would allow initiation of the bicycle exercise for a patient sooner as the exercise would require less mobility of the leg.

The specific structure of the instant invention provides a simple and efficient way for fixedly mounting the axle 30 supporting the pedal 26 along the entire length of the crank arm 26. Unlike prior art devices for extending crank arm lengths, the instant invention provides a means for effectively shortening the crank length to substantially a 2 inch radius.

The subject invention would have excellent clinical value in that it would enable therapist to reduce rehabilitation time with individuals, as well as adding more versatility to the existing exercise cycle concept.

The instant invention further provides a method of ajusting the exercise bicycle assembly 10 including the steps of increasing the distance between the seat 18 and the body 12 and decreasing the distance between the pivotal connection 30 of the foot pedal 28 and the pivotal connection 42 of the crank arm 26. The step of decreasing the distance between the foot pedal connection 30 and the crank arm connection 42 is accomplished by moving the foot pedal connection 30 to one of several positions along the entire length of the crank arm 26 and fixedly connecting the foot pedal connection at the selected position.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed:

1. An exercise machine assembly (10) comprising: a body portion (12); handle means (16) mounted on said body portion (12) for being manually grasped; a seat (18) supported by said body portion (12) and spaced from said handle means (16); a pair of crank arms (26) supported by said body portion (12) for rotational movement; a foot pedal (28) mounted on each of said crank arms (26); adjustable pedal support means for adjustably fixedly supporting each of said pedals (28) at any one of a purality of positions along said entire length of said crank arms (26), and characterized by including a pedal block (32) and an axle member (30) extending therefrom and supporting said foot pedal (32) thereon for rotational movement relative thereto, said adjustable pedal support means including a clamping arm (34) pivotally connected to said crank arm (26) and crank arm locking means for locking said clamping arm (34) to said crank arm (26), said clamping arm having an unclamped position wherein said pedal block (32) is movable along said entire length of said crank arm (26) and a clamped position wherein said pedal block (32) is fixedly clamped between said crank arm (26) and clamping arm (34) at a position along said length of said crank arm (26).

2. An assembly as set forth in claim 1 further characterized by including variable length seat support means for selectively spacing said seat (18) from said body portion (12).

3. An assembly as set forth in claim 2 further characterized by said variable length seat support means including a shaft member (20) having two ends and a predetermined length, said seat (18) being mounted on one of said ends of said shaft member (20), said body portion (12) including a port for telescopically receiving said other end of said shaft member (20), said variable length seat support means further including locking means for locking selected portions of said shaft member (20) along said length thereof within said port.

4. An assembly as set forth in claim 1 further characterized by including indexing means for fixedly securing said pedal block (32) at predetermined spaced positions along said entire length of said crank arm (34).

5. An assembly as set forth in claim 4 further characterized by said indexing means including a plurality of notches (46) extending along said length of said clamping arm (34) in predetermined spaced positions, said pedal block (32) including projections (48) for mating engagement with at least one of said spaced notches (46) for indexing said pedal block (32) along said entire length of said clamping arm (34).

6. An assembly as set forth in claim 4, further characterized by said indexing means including a plurality of projections (46) extending along said length of said crank arm (26) in predetermined spaced positions, said pedal block (32) including notches for mating engagement with at least one of said spaced projections (46) for indexing said pedal block (32) along said entire length of said crank arm (26).

7. An assembly as set forth in claim 4 further characterized by said crank arm locking means including a leg (50) extending substantially perpendicularly from said clamping arm (34) towards said crank arm (26) and an adjustable locking member (52) for selectively engaging said leg (50) for retaining said leg (50) adjacent said crank arm (26).

8. An assembly as set forth in claim 7 further characterized by said leg (50) including a notch (54) therein, said locking member (52) including a projection (56) extending therefrom and being adjustable mounted on said crank arm (26) to be movable from a locking position wherein said projection (56) is seated within said notch (54) to an unlocked position wherein said projection (56) is spaced from said notch (54).

9. An assembly as set forth in claim 8 further characterized by said crank arm (26) having a first end pivotally connected to said clamping arm (34) and a second end having said locking member (52) mounted thereon, said crank arm (26) including guide means for guiding said locking member (52) between said locked and unlocked positions.

10. An assembly as set forth in claim 9 wherein said guide means includes a pair of spaced pins (66,68) extending from said second end of said crank arm (26), said locking member (52) being slideably supported along said pins (66,68).

11. An assembly as set forth in claim 10 further characterized by including a bolt member (58) having a first end (60) connected to said crank arm (26) and a threaded body portion (62) extending through said locking member (52), said locking means including a nut member (64) mounted on said threaded body portion (64) for securing said locking member (52) in said locked position and selectively releasing said locking member (52) therefrom.

12. An assembly as set forth in claim 1 further characterized by said clamping arm (34) having a predetermined thickness and including an opening through said thickness and extending along said length thereof, said axle member (30) extending through said opening and having a length greater than said thickness of clamping arm (34).

* * * * *